US011299309B2

(12) United States Patent
Zhou

(10) Patent No.: US 11,299,309 B2
(45) Date of Patent: Apr. 12, 2022

(54) VACUUM PRESERVATION MACHINE CAPABLE OF PRINTING DATE CODE

(71) Applicant: XIAMEN YOUO INTELLIGENT TECHNOLOGY CO., LTD, Xiamen (CN)

(72) Inventor: Yiyun Zhou, Xiamen (CN)

(73) Assignee: XIAMEN YOUO INTELLIGENT TECHNOLOGY CO., LTD, Xiamen (CN)

( * ) Notice: Subject to any disclaimer, the term of this patent is extended or adjusted under 35 U.S.C. 154(b) by 14 days.

(21) Appl. No.: 16/769,650

(22) PCT Filed: Nov. 30, 2018

(86) PCT No.: PCT/CN2018/118690
§ 371 (c)(1),
(2) Date: Jun. 4, 2020

(87) PCT Pub. No.: WO2019/109869
PCT Pub. Date: Jun. 13, 2019

(65) Prior Publication Data

US 2021/0179306 A1 Jun. 17, 2021

(30) Foreign Application Priority Data

Dec. 4, 2017 (CN) ..... 201721662485.6
Dec. 4, 2017 (CN) ..... 201721664332.5

(51) Int. Cl.
*B65B 61/26* (2006.01)
*B41K 3/08* (2006.01)
*B65B 31/04* (2006.01)

(52) U.S. Cl.
CPC ..... *B65B 61/26* (2013.01); *B41K 3/08* (2013.01); *B65B 31/048* (2013.01)

(58) Field of Classification Search
CPC ..... B65B 61/26; B65B 31/048; B65B 31/04; B65B 31/043; B65B 31/06; B65B 7/02;
(Continued)

(56) References Cited

U.S. PATENT DOCUMENTS 1,811,359 A * 6/1931 Kern ..... B65B 61/025 101/318
2,249,627 A * 7/1941 Drucker ..... B44B 5/028 101/110

(Continued)

FOREIGN PATENT DOCUMENTS

CN 2635530 Y 8/2004
CN 205738354 U 11/2016

(Continued)

OTHER PUBLICATIONS

International Search Report issued in corresponding International application No. PCT/CN2018/118690, dated Feb. 26, 2019(2 pages).

(Continued)

*Primary Examiner* — Dariush Seif

(57) ABSTRACT

A vacuum preservation machine capable of printing date codes includes an upper cover and a lower cover connected together and capable of opening and closing, the upper cover and the lower cover are respectively provided with an upper sealing foam and a lower sealing foam at corresponding positions, an upper side of the lower cover is provided with a preservation bag and the opening of the preservation bag is located on the inner side of the lower sealing foam, when the upper cover is closed, the upper sealing foam and lower sealing foam can be fit together to formed a sealing chamber to vacuum the preservation bag, the upper cover is provided with a printing wheel at the position of the inner side of the upper sealing foam; the lower cover is provided with a block at the position of the inner side of the lower sealing foam.

6 Claims, 8 Drawing Sheets

(58) Field of Classification Search
CPC ..... B65B 7/06; B65B 43/12; B65B 43/123; B65B 43/14; B65B 43/22; B65B 51/146; B41K 3/08
USPC ..... 53/510, 512, 79, 374.8, 374.9, 389.2, 53/389.3
See application file for complete search history.

(56) References Cited

U.S. PATENT DOCUMENTS 3,908,543 A * 9/1975 Wirth ..... G06C 11/00 101/110
4,181,560 A * 1/1980 Maitland ..... B41K 3/08 101/103
4,774,881 A * 10/1988 Schubert ..... B41J 7/34 101/110
5,113,059 A * 5/1992 Brewster, Jr. .... G07B 17/00508 235/101
5,879,609 A 3/1999 Fujita
7,377,087 B2 * 5/2008 Clarke ..... B65B 31/08 53/434
7,913,618 B2 * 3/2011 Ferry ..... B44B 5/026 101/3.1
2005/0205455 A1 * 9/2005 Harrison ..... B65D 81/2023 206/524.8
2017/0008655 A1 * 1/2017 Amano ..... B65H 16/103
2018/0162569 A1 * 6/2018 Day ..... B65B 31/024
2019/0009941 A1 * 1/2019 Schandel ..... B65B 61/26
2019/0009942 A1 * 1/2019 Hermans ..... B65B 61/025

FOREIGN PATENT DOCUMENTS

CN 206087460 U 4/2017
CN 207510789 U 6/2018

OTHER PUBLICATIONS

Written Opinion of the International Searching Authority for No. PCT/CN2018/118690.

* cited by examiner

VACUUM PRESERVATION MACHINE CAPABLE OF PRINTING DATE CODE

TECHNICAL FIELD

The present disclosure relates to a vacuum preservation machine capable of printing date codes.

BACKGROUND

Current vacuum preservation machines generally do not have the function of printing production dates and batch number, so customers can not exactly know the production date of food in the preservation bag, so a vacuum preservation machine having a printing production date and batch number function is urgently needed.

SUMMARY OF DISCLOSURE

The present disclosure provides a vacuum preservation machine capable of simultaneously printing date codes, which can effectively solve the above problems.

The disclosure is realized in this way:

A vacuum preservation machine capable of simultaneously printing date codes, comprising an upper cover and a lower cover connected together and capable of opening and closing, the upper cover and the lower cover are respectively provided with an upper sealing foam and a lower sealing foam at corresponding positions, an upper side of the lower cover is provided with a preservation bag and the opening of the preservation bag is located on the inner side of the lower sealing foam, when the upper cover is closed, the upper sealing foam and lower sealing foam can be fit together to formed a sealing chamber to vacuum the preservation bag, the upper cover is provided with a printing wheel at the position of the inner side of the upper sealing foam;

the lower cover is provided with a block at the position of the inner side of the lower sealing foam, and the opening of the preservation bag crosses the block so that the bag body of the preservation bag is placed on the upper side of the block;

when the upper cover is closed, the printing wheel can press the bag body onto the block.

Further, the block is hot-melt or stamped.

Further, the inner side of the sealing foam is provided with a reservoir, the opening of the preservation bag extends into the reservoir.

Further, the block is located in the reservoir.

The beneficial effects of the present disclosure are:

The vacuum preservation machine of the disclosure provides a printing wheel and a block so that when the upper cover and the lower cover are locked or vacuum tightened, the upper printing wheel presses the preservation bag on the block of the lower cover, thus enabling the printing wheel to print date codes on the preservation bag, such as the date of today (month/day), so that the food vacuum storage time can be well tracked. Finally, the digital date of the surface of the preservation bag can be made clearer by setting a hot-melt or stamped block.

BRIEF DESCRIPTION OF DRAWINGS

In order to provide a clearer description of the technical scheme of the the present disclosure, it will be understood that the accompanying drawings required in the embodiments will be briefly described below, and that the following drawings only show some embodiments of the present disclosure, and therefore should not be regarded as a limitation of scope, and that, for ordinary technicians in the field, the drawings may be used in accordance with the requirements of the present disclosure without any creative effort. These drawings are available in other related drawings.

DETAILED DESCRIPTION

In order to make the purposes, technical schemes and advantages of the embodiments of the present disclosure clearer, the technical schemes of the embodiments of the present disclosure will be described clearly and completely below in conjunction with the accompanying drawings of the embodiments of the present disclosure. Obviously, the described embodiments are part of, but not all of, the embodiments of the present disclosure. Based on the embodiments of the disclosure, all other embodiments obtained by ordinary technicians in the art without creative work fall within the scope of protection of the disclosure. Accordingly, the following detailed description of the embodiments of the disclosure provided in the accompanying drawings is not intended to limit the scope of the disclosure requiring protection, but merely to represent selected embodiments of the disclosure. Based on the embodiments of the disclosure, all other embodiments obtained by ordinary technicians in the art without creative work fall within the scope of protection of the disclosure.

The disclosure is illustrated by way of example and not by way of limitation in the figures of the accompanying drawings in which like references indicate similar elements. It should be noted that references to "an" or "a" embodiment in this disclosure are not necessarily to the same embodiment, and such references mean "at least one."

In the description of the present disclosure, the terms "first", "second" are used only for descriptive purposes and cannot be understood as indicating or implying relative importance or implying the number of indicated technical features. Thus, a characteristic that is limited to "first" and "second" may include, expressly or implicitly, one or more of the characteristics. In the description of the present disclosure, "many" means two or more unless otherwise expressly and specifically limited.

Figure 1:
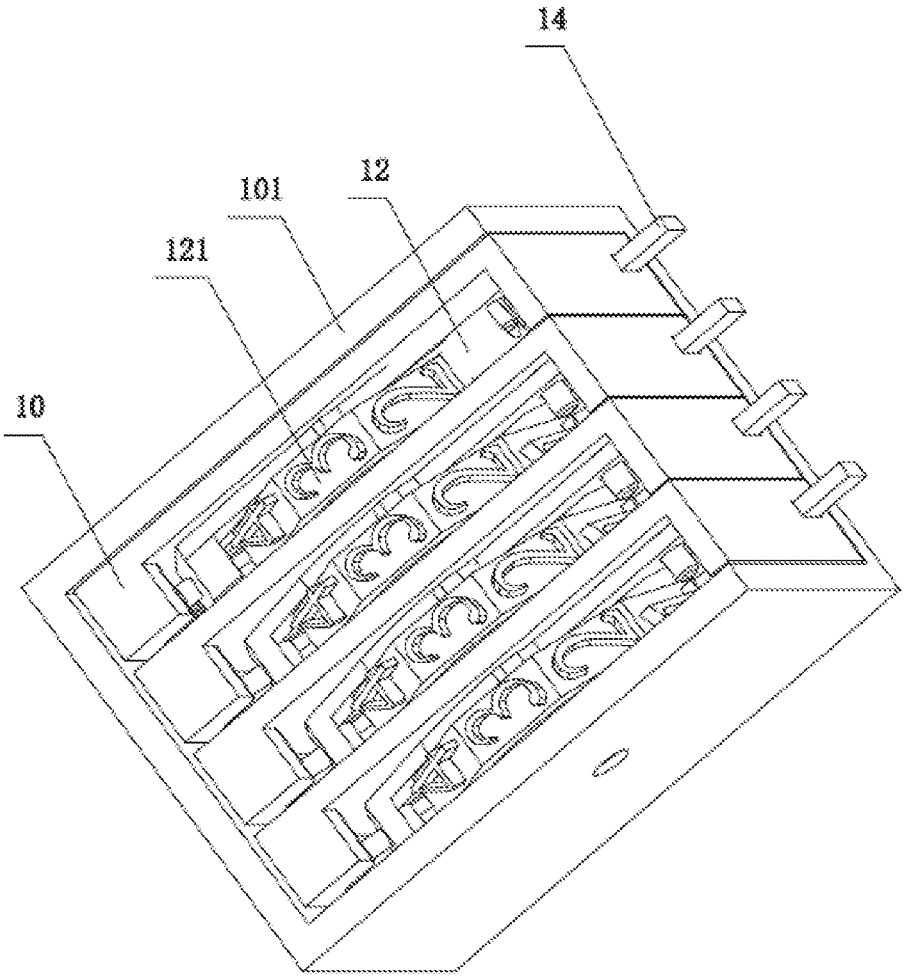
FIG. 1 is a schematic diagram of structure of a printing wheel of the disclosure.
Figure 2:
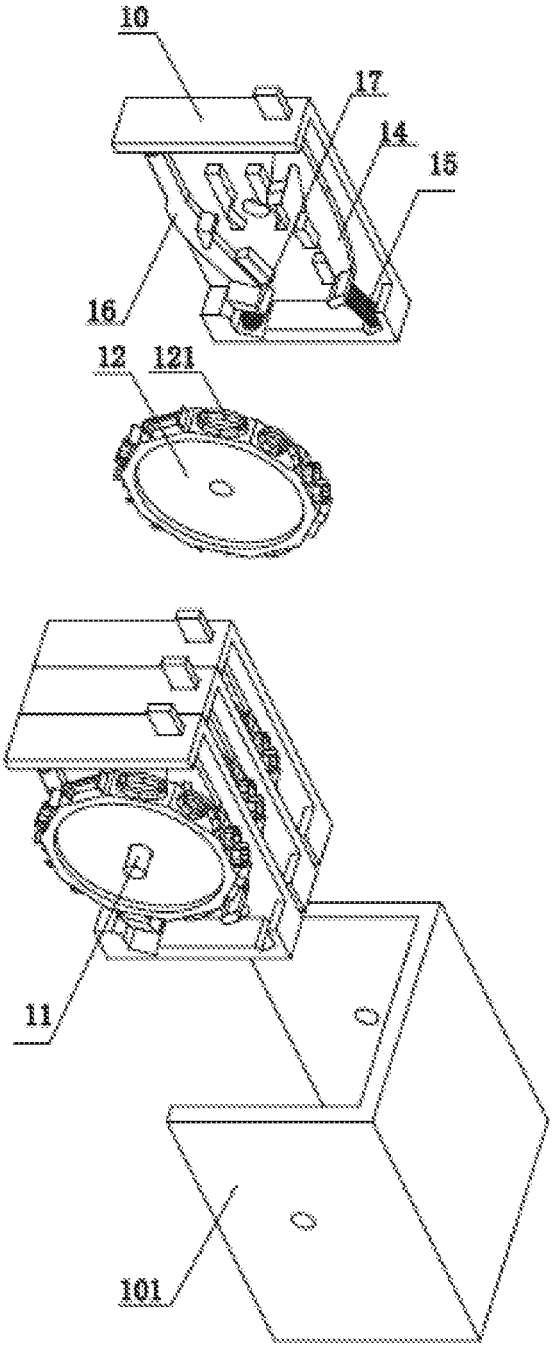
FIG. 2 is the first illustration of the split structure of FIG. 1.
Figure 3:
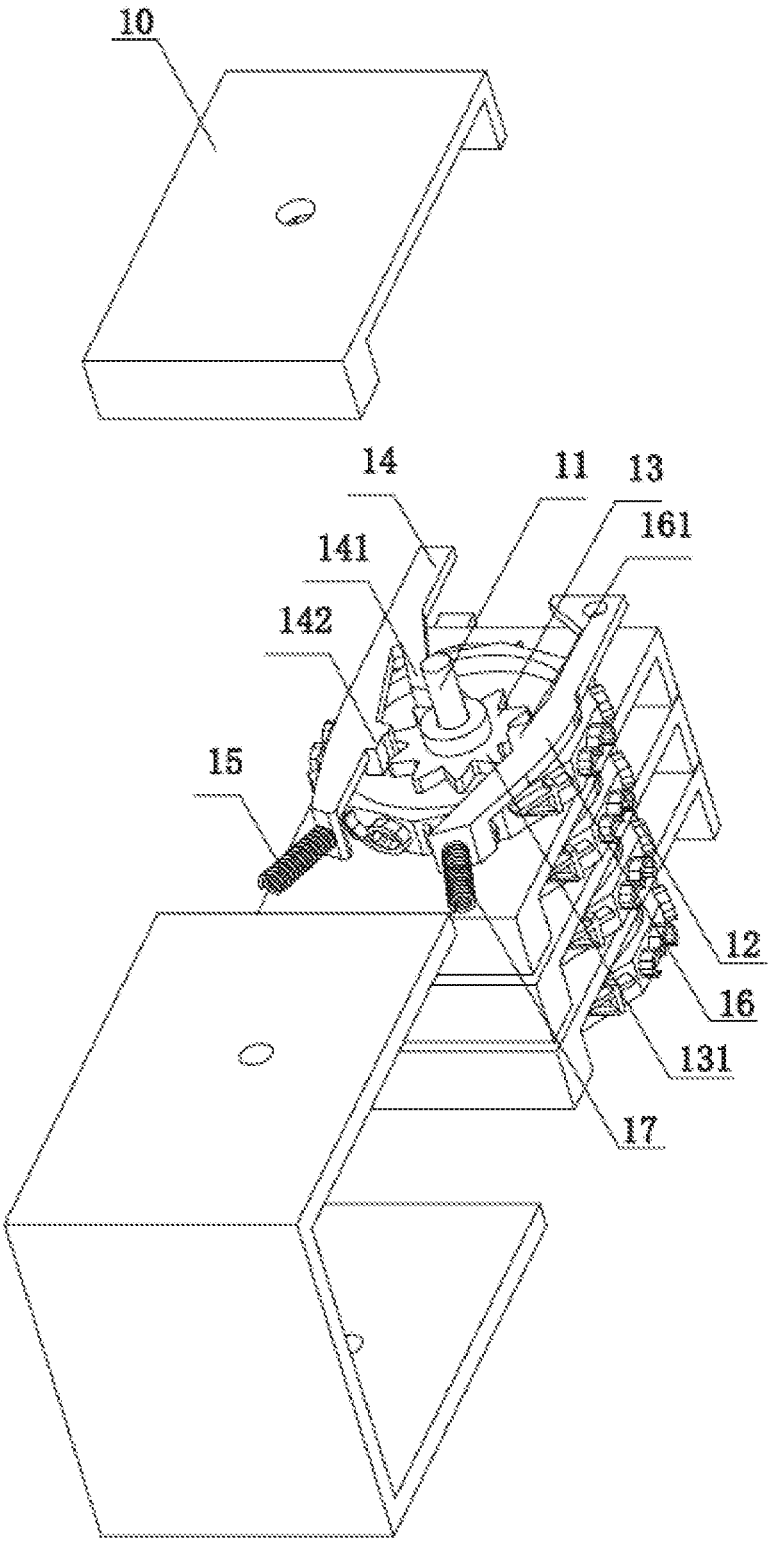
FIG. 3 is the second illustration of the split structure of FIG. 1.
Figure 4:
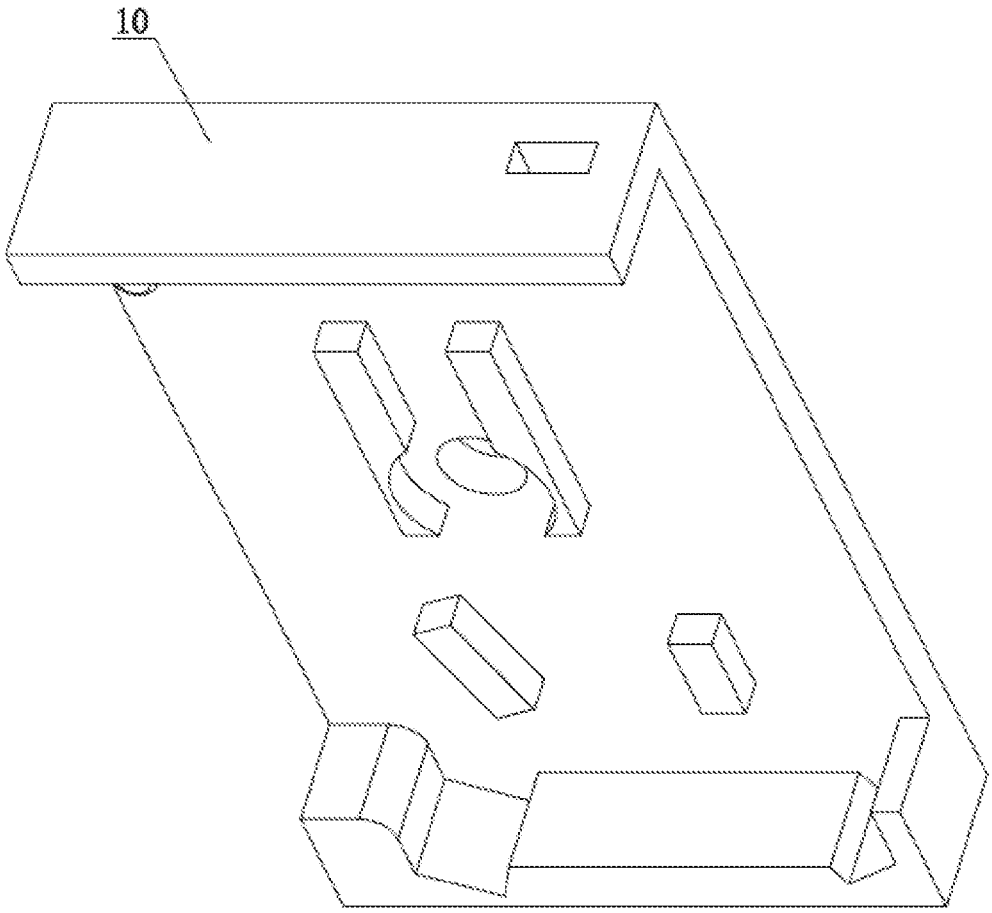
FIG. 4 is a structural diagram of the retaining plate of FIG. 1.

Referring to FIGS. 1-4, a printing wheel 100 for vacuum preservation machines includes:

a retaining plate 10;

a connecting shaft 11 fixedly arranged in the middle of the retaining plate 10;

a digital disc 12 surrounded by the required plural character templates 121 and is rotatably sleeved on the outside of the connecting shaft 11;

a gear 13 rotatably sleeved on the outside of the connecting shaft 11, is positioned between the retaining plate 10 and the digital disc 12 and is linked to the digital disc 12;

a first pushing rod 14 elastically connected to the retaining plate 10 and can abut against the gear 13. Pressing the first pushing rod 14 enables the first pushing rod 14 to push the gear 13 to rotate, thereby driving the digital disc 12 to rotate and releasing the first pushing rod 14, thereby restoring the first pushing rod 14 to its original state.

By the first pushing rod 14, the user can turn the digital disc 12 just by pushing the first pushing rod 14, thus changing the imprinted words, which is easy to operate and very suitable for the existing vacuum preservation machine. It can be used only by installing the printing wheel 100 in the vacuum preservation machine as a whole, without further modification of the vacuum preservation machine, thus saving production cost of the company.

Specifically, one end of the first pushing rod 14 extends through the retaining plate 10 to the outside of the retaining plate 10 to be pressed by the user, and the other end abut against the inner wall of the retaining plate 10 through a first spring 15.

Specifically, the side of the first pushing rod 14 is provided with a pushing block 141 and a first clamp block 142 for driving the gear 13 to rotate; when the first pushing rod 14 is not pushed, the first clamp block 142 is located between two adjacent teeth 131 on the gear 13. When in use, the user presses the first pushing rod 14 to extend to one end of the outer side of the retaining plate 10 to compress the first spring 15 at the other end, while the pushing block 141 pushes the gear to rotate. When pressed in place, the printed surface 121 of the digital disc 12 just changes from one character temple to another adjacent character temple. After releasing the pressure, the first pushing rod 14 is returned under the action of the first spring 15. At this time, the first clamp block 142 is set between the two teeth 131 to prevent the gear 13 from turning itself and to improve stability during printing.

The printing wheel 100 also includes a second pushing rod 16, one end of the second pushing rod 16 is rotatably connected to the retaining plate 10 and the other end abut against the inner wall of the retaining plate 10 through a second spring 17 with a second clamp block 161 on the side of the second pushing rod 16. When the first pushing rod 14 is not pushed, the second clamp block 161 is also clamped between two adjacent teeth on the gear 13. In addition, the first pushing rod 14 and the second pushing rod 16 are located on opposite sides of the gear 13, respectively, improving stability of digital disc 12 during printing.

Figure 5:
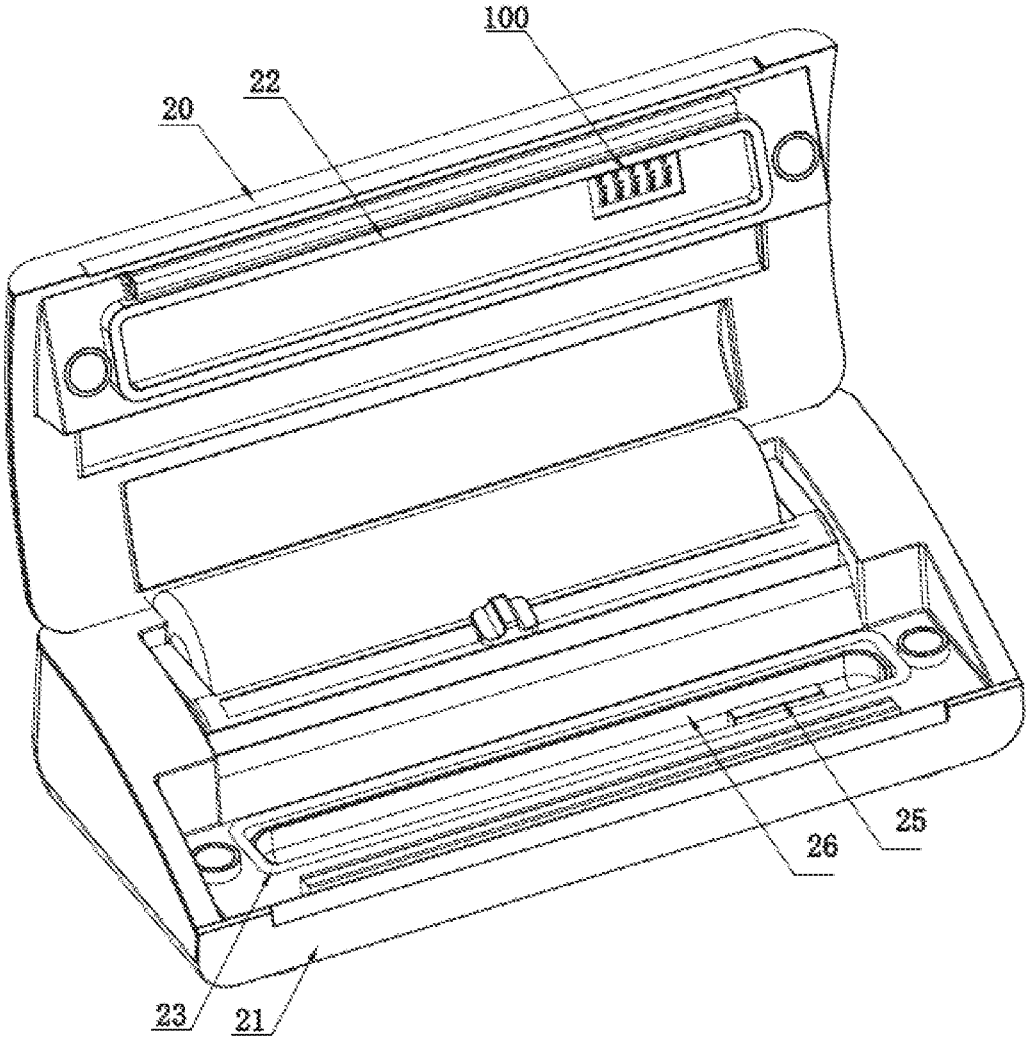
FIG. 5 is a structural diagram of a vacuum preservation machine of the disclosure.
Figure 6:
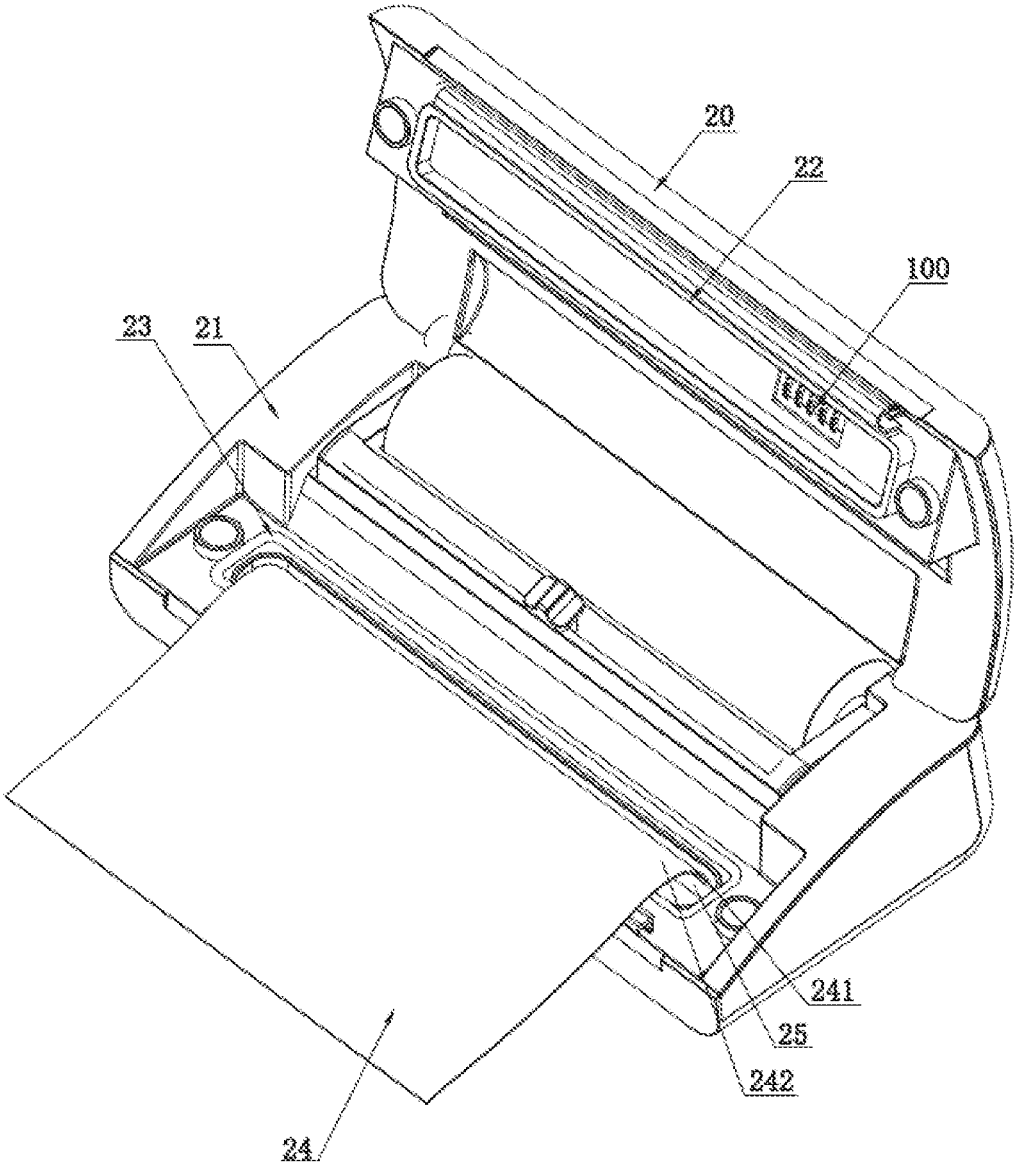
FIG. 6 is a structural diagram of a preservation bag as shown in FIG. 5.
Figure 7:
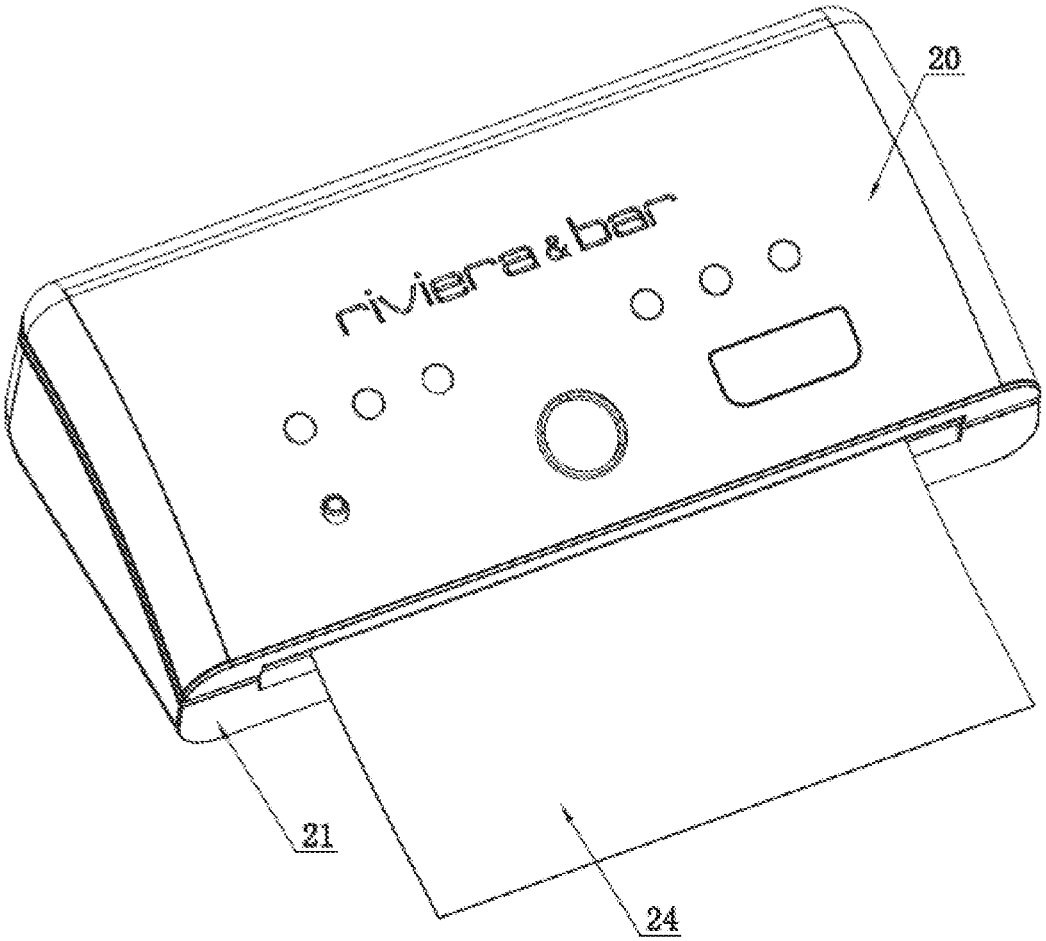
FIG. 7 is a structural schematic diagram of an upper cover and a lower cover in the vacuum preservation machine of the disclosure when they fit together.
Figure 8:
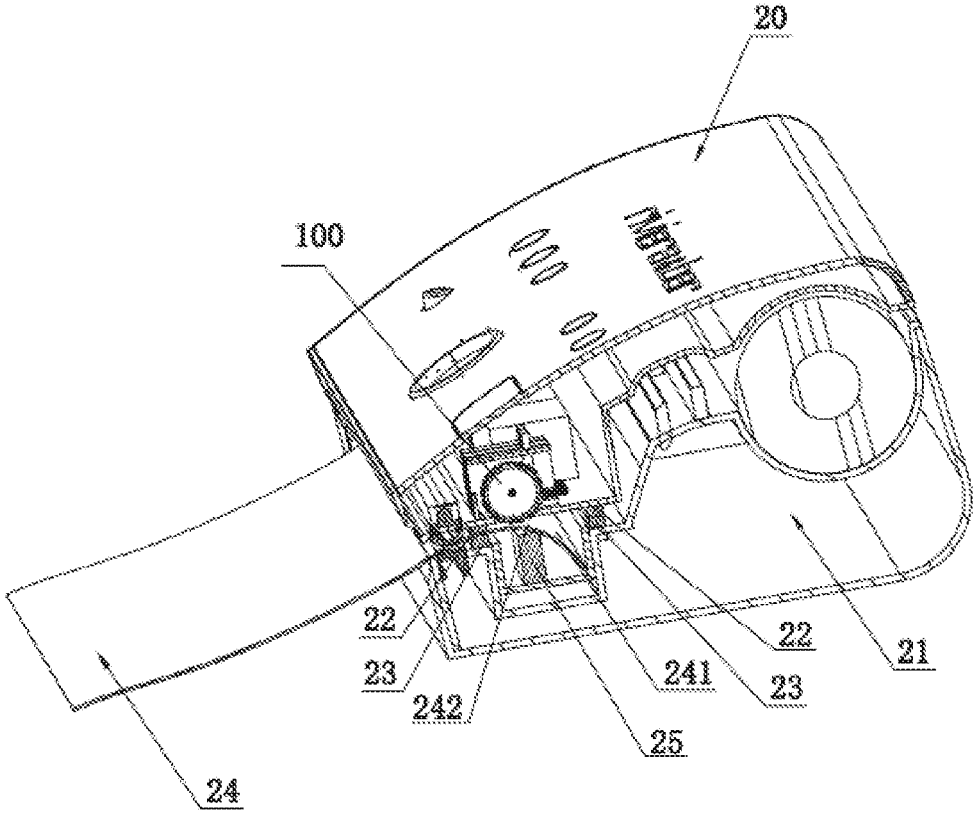
FIG. 8 is a cross-sectional view of FIG. 7.

Referring to FIGS. 5-8, a vacuum preservation machine capable of simultaneously printing date codes, an upper cover 20 and a lower cover 21 connected together and capable of opening and closing, the upper cover 20 and the lower cover 21 are respectively provided with an upper sealing foam 22 and a lower sealing foam 23 at corresponding positions, an upper side of the lower cover 21 is provided with a preservation bag 24 and the opening 241 of the preservation bag 24 is located on the inner side of the lower sealing foam 23, when the upper cover 20 is closed, the upper sealing foam 22 and lower sealing foam 23 can be fit together to formed a sealing chamber to vacuum the preservation bag 24.

One or a plurality of connected printing wheels 100 side-by-side can be mounted on the upper cover 20 and the printing surface of the printing wheel 121 faces down. When the upper cover 20 is closed to fit the lower cover 21, the printing wheel 100 can print the characters on the preservation bag 24 below. When there are a plurality of the printing wheel 100, it can be fixed together through the outer frame 10 to facilitate installation.

The printing wheel 100 is mounted on the upper cover 20 at the position of the inner side of the upper sealing foam 22.

A block 25 is arranged on the upper part of the lower cover 21 at the position of the inner side of the lower sealing foam 23, and the opening 241 of the preservation bag crosses the block 25 so that the bag body 242 of the preservation bag 24 is placed on the upper side of the block 25.

When the upper cover 20 is closed, the printing wheel 100 presses the bag body 242 on the block 25.

By setting the printing wheel 100 and block 25, the printing wheel 100 of the upper cover 20 will press the preservation bag 24 onto the block 25 of the lower cover 21 when the upper cover 20 and the lower cover 21 are locked or vacuum-tightened, so that the date code on the printing wheel 100 can be printed on the preservation bag 24, such as the date of today (month/day), thus the food vacuum storage time can be well tracked.

Specifically, the above mentioned block 25 is a hot melt or stamped. The digital date of the surface of the preservation bag 24 can be made clearer by setting a hot-melt or stamped block.

The inner side of the lower sealing foam 23 has a reservoir 26, and the opening 241 of the preservation extends into the reservoir 26. This setting enables the juice overflow from the preservation bag 24 to flow directly into the reservoir when vacuum is pumped. After vacuum is pumped, it can be recycled again, thus avoiding contamination and damage to the machine. The block is located in the reservoir.

The above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A vacuum preservation machine capable of printing date codes, comprising:

an upper cover and a lower cover connected together and capable of opening and closing;

the upper cover and the lower cover respectively provided with an upper sealing gasket and a lower sealing gasket made of a foam material at corresponding positions, and the upper sealing gasket and the lower sealing gasket each form an enclosure, an upper side of the lower cover is provided with a preservation bag and an opening of the preservation bag is located on an inner sidewall of the lower sealing gasket away from a front side of the vacuum preservation machine;

when the upper cover is closed, the upper sealing gasket and the lower sealing gasket can be fit together to form a sealing chamber to vacuum the preservation bag, wherein the upper cover is provided with a printing wheel located inside the enclosure of the upper sealing gasket;

the lower cover is provided with a block located inside the enclosure of the lower sealing gasket at a position opposite to the printing wheel, and the opening of the preservation bag crosses the block so that a bag body of the preservation bag is placed on an upper side of the block;

when the upper cover is closed, the printing wheel can press the bag body onto the block;

the printing wheel comprises:

a retaining plate;

a connecting shaft fixedly arranged in a middle of the retaining plate;

a digital disc surrounded by a plurality of character templates 121 and is rotatably sleeved outside the connecting shaft;

a gear rotatably sleeved on an outer side of the connecting shaft is positioned between the retaining plate and the digital disc and is linked to the digital disc;

a first pushing rod elastically connected to the retaining plate and can abut against the gear, pressing the first pushing rod enables the first pushing rod to push the gear to rotate, thereby driving the digital disc to rotate and releasing the first pushing rod, thereby restoring the first pushing rod to its original state; and a first end of the first pushing rod extends through the retaining plate to the outside of the retaining plate to be pressed by a user, and a second end abut against the inner wall of the retaining plate through a first spring.

2. The vacuum preservation machine capable of printing date codes according to claim 1, wherein the block is hot-melt or stamped.

3. The vacuum preservation machine capable of printing date codes according to claim 1, wherein a reservoir is provided within the enclosure of the lower sealing gasket, the opening of the preservation bag extends into the reservoir.

4. The vacuum preservation machine capable of printing date codes according to claim 3, wherein the block is located in the reservoir.

5. The vacuum preservation machine capable of printing date codes according to claim 1, a side of the first pushing rod is provided with a pushing block and a first clamp block for driving the gear to rotate; when the first pushing rod is not pushed, the first clamp block is located between two adjacent teeth on the gear.

6. The vacuum preservation machine capable of printing date codes according to claim 5, the printing wheel further comprises a second pushing rod, a first end of the second pushing rod is rotatably connected to the retaining plate and a second end of the second pushing rod abuts against an inner wall of the retaining plate through a second spring with a second clamp block on a side of the second pushing rod 16;

when the first pushing rod is not pushed, the second clamp block is also clamped between two adjacent teeth on the gear, and the first pushing rod and the second pushing rod are located on opposite sides of the gear, respectively.

* * * * *